US011346091B2

(12) United States Patent
Shapiro

(10) Patent No.: US 11,346,091 B2
(45) Date of Patent: May 31, 2022

(54) PLUNGER SANITATION DEVICE

(71) Applicant: Jeremy Shapiro, Largo, FL (US)

(72) Inventor: Jeremy Shapiro, Largo, FL (US)

( * ) Notice: Subject to any disclaimer, the term of this patent is extended or adjusted under 35 U.S.C. 154(b) by 0 days.

(21) Appl. No.: 17/193,417

(22) Filed: Mar. 5, 2021

(65) Prior Publication Data

US 2021/0277642 A1 Sep. 9, 2021

Related U.S. Application Data

(60) Provisional application No. 62/985,736, filed on Mar. 5, 2020.

(51) Int. Cl.

| | |
|---|---|
| ***E03D 9/00*** | (2006.01) |
| ***E03C 1/308*** | (2006.01) |
| ***A47K 17/00*** | (2006.01) |
| ***A47K 11/10*** | (2006.01) |

(52) U.S. Cl.

CPC ..... *E03D 9/00* (2013.01); *A47K 11/10* (2013.01); *A47K 17/00* (2013.01); *E03C 1/308* (2013.01)

(58) Field of Classification Search

CPC ..... E03D 9/00; A47K 17/00; A47K 11/10
USPC ..... 4/661
See application file for complete search history.

(56) References Cited

U.S. PATENT DOCUMENTS

| | | | | |
|---|---|---|---|---|
| 7,124,450 | B2 * | 10/2006 | Davidson | E03D 9/00 4/255.11 |
| 2007/0079460 | A1 * | 4/2007 | Tapp | A47K 11/10 15/210.1 |
| 2007/0207186 | A1 * | 9/2007 | Scanlon | A61F 2/91 424/424 |
| 2009/0049593 | A1 * | 2/2009 | Hodkiewicz | E03C 1/308 4/255.05 |
| 2011/0010832 | A1 * | 1/2011 | Tsiros | E03D 9/00 4/255.11 |
| 2018/0220860 | A1 * | 8/2018 | Singer | A47K 17/00 |

* cited by examiner

*Primary Examiner* — Christine J Skubinna
(74) *Attorney, Agent, or Firm* — Larson & Larson, P.A.; Frank Liebenow; Justin P. Miller

(57) ABSTRACT

A plunger sanitation device includes an elongated flexible container having an opening at one end and sides depending therefrom. A bottom portion depends from the sides at a distal end from the opening and the bottom portion sized to fit a circumference of a dome-shaped cup of a plunger. The elongated flexible container is water resistant and, in some embodiments, the bottom portion is concave are for extending into the dome-shaped cup of a plunger. In some embodiments, the elongated flexible container is made from a material that dissolves in water after use, allowing for flushing of the elongated flexible container.

14 Claims, 3 Drawing Sheets

PLUNGER SANITATION DEVICE

CROSS-REFERENCE TO RELATED APPLICATION

This application claims the benefit of U.S. provisional application No. 62/985,736 filed on Mar. 5, 2020, the disclosure of which is incorporated by reference.

FIELD

This invention relates to the field of sanitation and more particularly to a device for improving sanitation of a plunger for use in a toilet or urinal.

BACKGROUND

From time to time, every flush toilet will get clogged from excrement, paper products, sanitary products, etc. Likewise, sinks also get clogged, often from food matter and grease.

Looking at a store shelf, one will find countless products that promise to clear a clogged drain. These chemicals are often dangerous, poisonous, or ineffective. Further, after use, these chemicals wind up in sewerage systems and septic tanks where these chemicals are not wanted and have the potential to harm the environment.

Often, after trying to use such products, people resort to using the old-fashioned, low cost, less-polluting plunger. Such plungers often have a dome-shaped cup connected to an elongated handle. After inserting the dome-shaped end to cover the clogged drain, the handle is pushed down to collapse the dome-shaped cup and force air into the drain. The air pushes the material causing the clog further down the drain until it finds a larger drainage pipe and clears the clog. The plunger has been used to clear clogged drains/toilets for almost as long as inside plumbing has existed, but what happens to the plunger after it has been used? You now have a rubbery dome-shaped cup that has been submerged in a bath of often nasty material having all sorts of microbes that could be dangerous to one's health. Washing and cleaning of the plunger is not enjoyable and creates an opportunity for those microbes to enter the user's body and cause infection, especially if the user has an open cut. Those that are immuno-compromised are in grave danger when they clean a soiled plunger.

What is needed is a device that will keep the plunger clean and ready for a next use.

SUMMARY

In one embodiment, a plunger sanitation device is disclosed. The plunger has an elongated handle and a dome-shaped cup portion depending therefrom. The plunger sanitation device includes an elongated flexible container having an opening at one end and sides depending therefrom and a bottom portion depends from the sides at a distal end from the opening, the bottom portion sized to fit a circumference of a dome-shaped cup of a plunger. The elongated flexible container is made from a material that is water resistant. In some embodiments, the elongated flexible container is made from a material that will dissolve in water after use.

In another embodiment, a method of maintaining plunger sanitation is disclosed. The plunger has an elongated handle and a dome-shaped cup portion affixed to one end of the elongated handle. The method includes, after a clog occurs, placing the plunger into an elongated flexible container, the dome-shaped cup portion is inserted first. The elongate flexible container has an opening at one end, sides depending therefrom, and a bottom portion that depends from the sides at a distal end from the opening. The bottom portion covers a bottom of the dome-shaped cup portion of the plunger. Next, the plunger and elongated flexible container are positioned over the clog and the elongated flexible container protects the plunger from water and materials backed-up by the clog. The elongated handle of the plunger is then pushed (as many times as needed) to provide air pressure to the clog from the dome-shaped cup for dislodging the clog.

In another embodiment, a plunger sanitation device is disclosed. The plunger sanitation device includes an elongated flexible container that has an opening at one end and sides depending therefrom, and a bottom portion that depends from and seals the sides at a distal end from the opening. The bottom portion is concave for extending into the dome-shaped cup of the plunger and is sized to fit a circumference of a dome-shaped cup of a plunger. The elongated flexible container is made from a material that is water resistant and dissolves at a time after being exposed to water.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
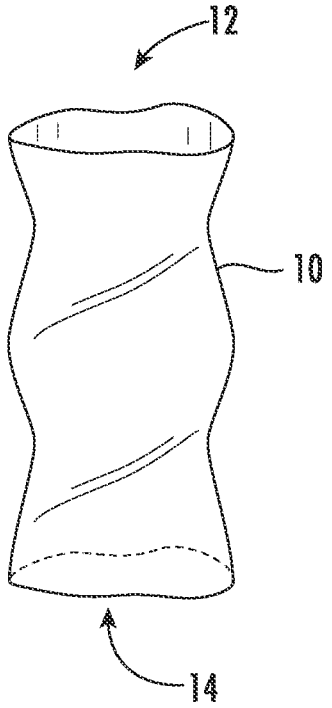
FIG. 1 illustrates a perspective view of a plunger sanitation device.

Reference will now be made in detail to the presently preferred embodiments of the invention, examples of which are illustrated in the accompanying drawings. Throughout the following detailed description, the same reference numerals refer to the same elements in all figures.

Figure 2:
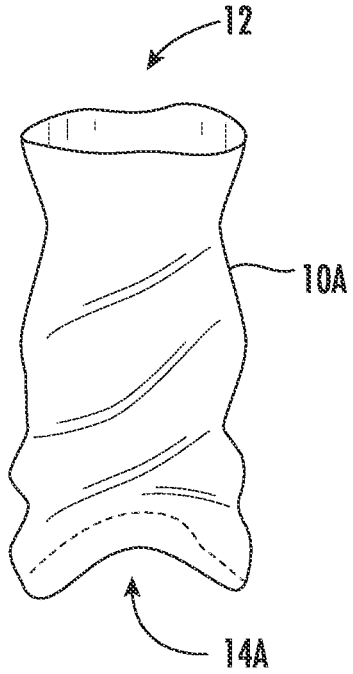
FIG. 2 illustrates a perspective view of the plunger sanitation device having a concave bottom.
Figure 3:
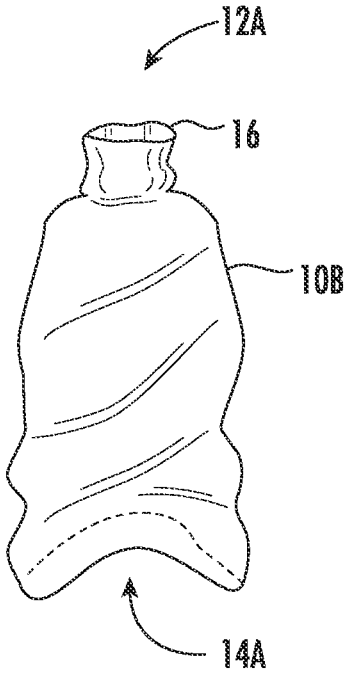
FIG. 3 illustrates a perspective view of the plunger sanitation device having a concave bottom and a resilient neck.

Referring to FIGS. 1, 2, and 3, perspective views of a plunger sanitation device 10/10A/10B are shown. The plunger sanitation device 10/10A/10B is an elongated flexible container or bag-like structure having sides with an opening 12/12A at one end for inserting the plunger 20 (see FIGS. 4 and 5) there within. When the plunger 20 is within the plunger sanitation device 10/10A/10B, the plunger 20 is shielded from getting soiled by any material that is within the bowl 34 of the toilet 30 (see FIGS. 4-6). The plunger sanitation device 10/10A/10B therefore keeps clean the plunger 20, shielding from fecal matter and other materials present in a clogged toilet 30.

In some embodiments, a bottom section 14 depending from the sides is flat and sized to allow the dome-shaped cup to rest upon the bottom section 14. In some embodiments, a concave bottom section 14A depending from the sides has a concave shape and is also sized to allow the dome-shaped cup to rest upon the concave bottom section 14A. The concave bottom section 14A is designed to allow the concave bottom section 14A to raise up into the dome-shaped cup when the plunger sanitation device 10/10A/10B is installed on the plunger 20, creating an air pocket when the pair are placed in a bowl 34 of a toilet 30 that is clogged (see FIGS. 4 and 5), so that when the handle 22 of the plunger 20 is pushed, air from the air pocket is forced down the drain 36 (see FIGS. 4 and 5) to clear the clog.

In some embodiments, the plunger sanitation device 10/10A/10B is made from a flexible material that resists penetration by water and other materials within the bowl 34, for example, the plunger sanitation device 10/10A/10B is made from a plastic-based or rubber-based material. In some embodiments, after use, the plunger sanitation device 10/10A/10B, being soiled, is removed from the plunger 20 and disposed in the trash. In such, it is preferred that the plunger sanitation device 10/10A/10B be turned inside-out as the plunger sanitation device 10/10A/10B is removed from the plunger so that the soiled side of the plunger sanitation device 10/10A/10B is then on the inside.

In some embodiments, the plunger sanitation device 10/10A/10B is made from a material that dissolves in water after use, for example, a material that dissolves in five to ten minutes after exposure to water. In such, after use, the plunger sanitation device 10/10A/10B is flushed down the drain 36 (see FIGS. 4-6) after the plunger 20 is removed from the plunger sanitation device 10/10A/10B. Thereafter, the plunger sanitation device 10/10A/10B travels through the sewerage system and dissolves on the way to the sewerage treatment plant. Many such dissolving plastic materials are known, for example, polyvinyl alcohol which is the material commonly used for pharmaceutical capsules that people ingest. Some such materials are made of polyvinyl alcohol combined with plant-based starch, glycerin and optionally water. Some such materials are made of polyphosphazenes.

In some embodiments, the opening 12/12A is plain, allowing for insertion of the plunger into the plunger sanitation device 10/10A/10B while in other embodiments, the opening 12/12A has a resilient material (e.g., rubber band-like) to hold the plunger sanitation device 10/10A/10B to the handle 22 of the plunger 20.

Although any shape is anticipated for the plunger sanitation device 10/10A/10B, a tubular-shape (as shown) is preferred to match the shape of the dome-shaped cup 24 of the plunger 20. Further, the length of the plunger sanitation device 10/10A/10B is preferably sufficient to allow the opening 12 to be held above the water level of an intended target—the toilet 30.

It is anticipated that the plunger sanitation device 10/10A/10B be made from any flexible, water repelling material or material coated with a water repellent such as plastics and rubber. By water repellent, it is meant that the plunger sanitation device 10/10A/10B resists water pressure and keeps water from the bowl 34 of the toilet 30 from entering the inner cavity of the plunger sanitation device 10/10A/10B during use. In some embodiments, the plunger sanitation device 10/10A/10B is made from a flexible, water repelling material that is bio-degradable or dissolvable (see above) so that the plunger sanitation device 10/10A/10B is flushable after use. In such, the plunger sanitation device 10/10A/10B will dissolve shortly after contact with water in the toilet, for example, in two or three minutes after contact with the water.

Figure 4:
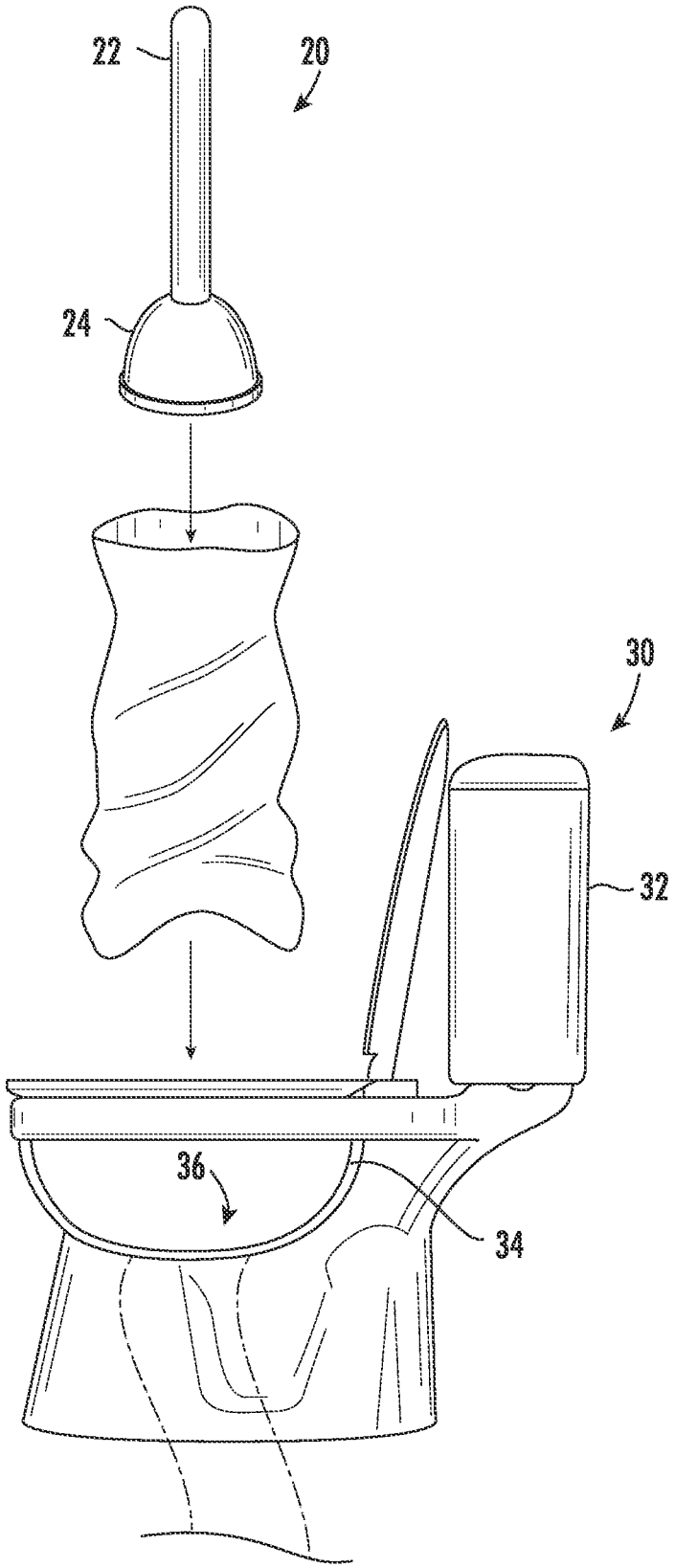
FIG. 4 illustrates a perspective view of the plunger sanitation device being fitted onto a plunger before use.
Figure 5:
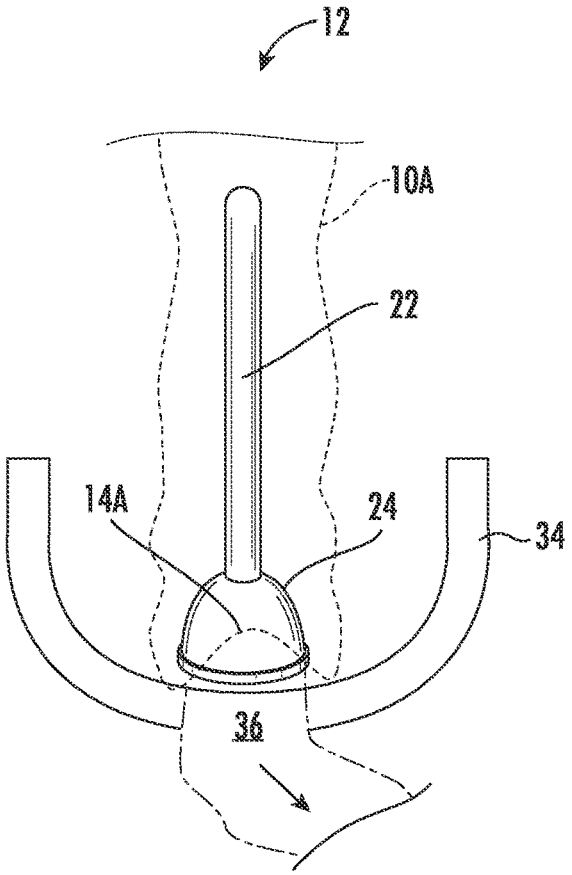
FIGS. 5 and 6 illustrate views of the plunger sanitation device installed on a plunger during use.
Figure 6:
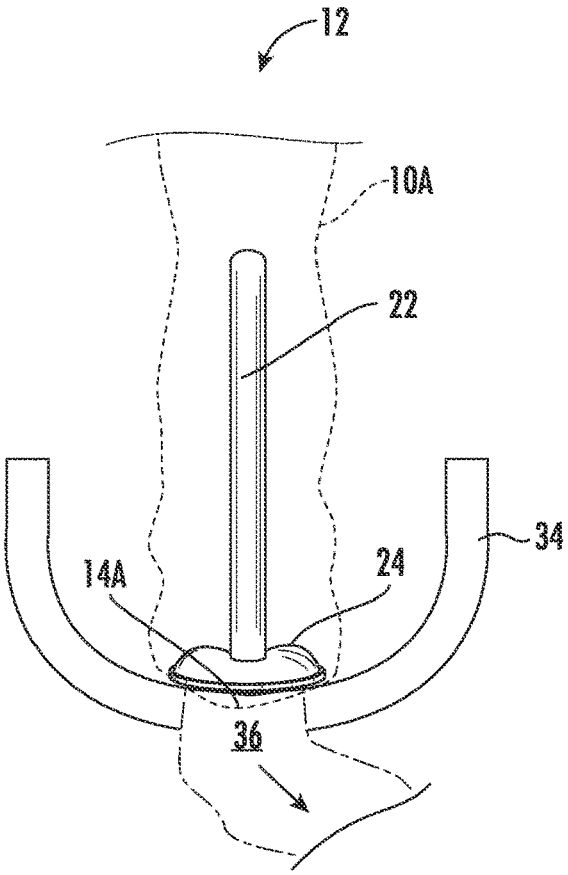

Referring to FIGS. 4 and 5, perspective views of the plunger sanitation device 10/10A/10B are shown being fitted onto a plunger before use in FIG. 4 and installed on a plunger during use in FIG. 5. In use, the plunger sanitation device 10/10A/10B is held open at the opening 12 and the plunger 20 is inserted partially into the plunger sanitation device 10/10A/10B. The dome-shaped cup 24 of the plunger 20 is positioned at the bottom section 14 or concave bottom section 14A of the plunger sanitation device 10/10A/10B. Although not required, it is anticipated that some of the handle 22 of the plunger 20 will extend out of the opening 12.

Now, the dome-shaped cup 24 of the plunger 20 is inserted into the bowl 34 of the toilet 30 so that the dome-shaped cup 24 substantially covers the drain 36. The handle 22 is then pushed/released one or more times to force air from within the dome-shaped cup 24 down into the drain 36 to free the clog and allow water from the toilet 30 to flow.

Once the clog frees, the plunger 20 is lifted above the water in the bowl 34 of a toilet 30 and the plunger sanitation device 10/10A/10B is removed, for example, turning the plunger sanitation device 10/10A/10B inside-out, thereby retaining any contaminants within the plunger sanitation device 10/10A/10B for disposal. Alternately, for embodiments in which the plunger sanitation device 10/10A/10B is made of a bio-degradable material or dissolvable material, the plunger sanitation device 10/10A/10B is simply slid off of the plunger 20 and flushed down the drain 36. For completeness, a toilet tank 32 is shown, though any type of toilet is anticipated.

Note that the above description is described using a toilet 30 as an example of a fixture having a clogged drain 36, but it is fully anticipated that the plunger sanitation device 10/10A/10B be used with a plunger 20 (or similar device) to clear a clog in any plumbing fixture, For example, a sink, a shower, a bathtub, a urinal, a basement drain, etc.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A plunger sanitation device for protecting a plunger that has an elongated handle and a dome-shaped cup portion depending therefrom, the plunger sanitation device comprising:

an elongated flexible container consisting of polyvinyl alcohol having an opening at one end and sides depending therefrom;

a bottom portion consisting of the polyvinyl alcohol depends from the sides at a distal end from the opening, sealing the sides, the bottom portion sized to fit a circumference of a dome-shaped cup of the plunger; and whereas the elongated flexible container is water resistant.

2. The plunger sanitation device of claim 1, wherein the bottom portion is concave are for extending into the dome-shaped cup of the plunger when the plunger sanitation device is installed on the plunger.

3. The plunger sanitation device of claim 1, wherein the elongated flexible container and the bottom portion begin to bio-degradable upon contact with water for flushing after use.

4. The plunger sanitation device of claim 1, wherein the elongated flexible container and the bottom portion dissolves at a time after being exposed to water.

5. The plunger sanitation device of claim 1, wherein the elongated flexible container and the bottom portion dissolve in from five to ten minutes after being exposed to water.

6. A method of maintaining sanitation of a plunger, the plunger having an elongated handle and a dome-shaped cup portion affixed to one end of the elongated handle, the method comprising:

after a clog occurs, placing the plunger into an elongated flexible container by inserting firstly the dome-shaped cup portion, the elongate flexible container consisting of polyvinyl alcohol and having an opening at one end, and sides depending therefrom, and a bottom portion that depends from and seals the sides at a distal end from the opening, the bottom portion covering a bottom side of the dome-shaped cup portion of the plunger;

inserting the plunger and elongated flexible container over the clog, the elongated flexible container protecting the plunger from water and materials backed-up by the clog; and pushing down on the elongated handle of the plunger to provide air pressure to the clog from the dome-shaped cup portion for dislodging the clog.

7. The method of claim 6, further comprising a step of removing the elongated flexible container from the plunger and disposing of the elongated flexible container.

8. The method of claim 7, wherein during the step of removing the elongated flexible container from the plunger, the elongated flexible container is turned inside out, a soiled side is now inside the elongated flexible container.

9. The method of claim 6, wherein the bottom portion is concave for extending into the dome-shaped cup portion of the plunger when the elongated flexible container is installed on the plunger.

10. The method of claim 6, wherein the elongated flexible container and the bottom portion start to bio-degrade upon contact with water after use and the method further comprises removing the elongated flexible container from the plunger and flushing the elongated flexible container.

11. The method of claim 6, wherein the elongated flexible container and the bottom portion dissolves at a time after being exposed to water and the method further comprises removing the elongated flexible container from the plunger and flushing the elongated flexible container.

12. The method of claim 6, wherein the elongated flexible container and the bottom portion dissolves in from five to ten minutes after being exposed to water and the method further comprises removing the elongated flexible container from the plunger and flushing the elongated flexible container.

13. A plunger sanitation device for protecting a plunger that has an elongated handle and a dome-shaped cup portion depending therefrom, the plunger sanitation device comprising:

an elongated flexible container consisting of polyvinyl alcohol having an opening at one end and sides depending therefrom;

a bottom portion consisting of the polyvinyl alcohol depends from the sides at a distal end from the opening, the bottom portion is concave for extending into the dome-shaped cup portion of the plunger and is sized to fit a circumference of the dome-shaped cup portion of the plunger; and whereas the elongated flexible container is made from a material that is water resistant and dissolves at a time after being exposed to water.

14. The plunger sanitation device of claim 13, wherein the elongated flexible container and the bottom portion dissolve at a time after being exposed to the water.

* * * * *